US006951032B1

(12) United States Patent
Rifkin

(10) Patent No.: US 6,951,032 B1
(45) Date of Patent: Oct. 4, 2005

(54) THUMB PROTECTION DEVICE

(76) Inventor: Mark Rifkin, 7 Rolling Rd., Somerset, NJ (US) 08873

( * ) Notice: Subject to any disclaimer, the term of this patent is extended or adjusted under 35 U.S.C. 154(b) by 36 days.

(21) Appl. No.: 10/741,552

(22) Filed: Dec. 19, 2003

(51) Int. Cl.[7] ..... A41D 13/00
(52) U.S. Cl. ..... 2/21
(58) Field of Search ..... 2/16, 19, 20, 21, 2/159, 161.1, 161.2, 163; 128/880; 602/22

(56) References Cited

U.S. PATENT DOCUMENTS 207,708 A * 9/1878 Boyer ..... 294/25
560,377 A * 5/1896 Stewart ..... 30/123.5
617,929 A * 1/1899 Fowble ..... 2/21
1,231,194 A * 6/1917 Prince ..... 602/58
2,434,317 A * 1/1948 Gross ..... 2/21
2,637,031 A * 5/1953 Friedman ..... 2/21
2,740,121 A * 4/1956 Seidel ..... 2/21
3,343,177 A * 9/1967 Bellamy ..... 2/21
4,694,508 A 9/1987 Iriyama et al.
4,733,410 A * 3/1988 Glotkin ..... 2/21
4,987,611 A * 1/1991 Maye ..... 2/19
5,063,613 A * 11/1991 Brown ..... 2/21
5,517,692 A * 5/1996 Wunderlich-Kehm ..... 2/21
5,963,985 A 10/1999 Behr et al.
5,996,117 A 12/1999 Goldsmith et al.
6,532,594 B1 * 3/2003 Barnett ..... 2/20
6,532,963 B2 * 3/2003 Swanbeck ..... 128/880

* cited by examiner

*Primary Examiner*—Gary L. Welch

(57) ABSTRACT

A thumb protection device for preventing injury to a person's thumb while playing a sport such as baseball includes a tubular main member of a padding material. The tubular main member fits snugly over the thumb of a user and includes a slit to facilitate wearing of the device by persons having widely varied thumb sizes.

7 Claims, 3 Drawing Sheets

THUMB PROTECTION DEVICE

BACKGROUND OF THE INVENTION

1. Field of the Invention

The present invention relates to body protection devices and more particularly pertains to a new thumb protection device for preventing injury to a person's thumb while playing a sport such as baseball.

2. Description of the Prior Art

The use of body protection devices is known in the prior art. U.S. Pat. No. 4,694,508 describes a cap for protecting the tip of a finger within a work glove. Another type of body protection device is U.S. Pat. No. 5,963,985 having a rigid cap member, support member and base engaging the root of the thumb of a user. U.S. Pat. No. 5,996,117 discloses a rigid half-pipe shaped thumb protector incorporated into an athletic glove.

While these devices fulfill their respective, particular objectives and requirements, they do not provide the combination of an open end for maximum feel with protection for the complete circumference around a distal joint of a thumb. The distal joint of the thumb provides greater circumference than the portions directly adjacent to the joint and therefore this joint receives enhanced impact force when the hand is used impacted. The need remains for a device that maximizes feel, readily fits various thumb sizes, and protects the medial joint portions of a user's thumb while playing sports.

SUMMARY OF THE INVENTION

The present invention generally comprises a tubular main member of a padding material. The tubular main member fits snugly over the thumb of a user and includes a slit to facilitate wearing of the device by persons having widely varied thumb sizes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
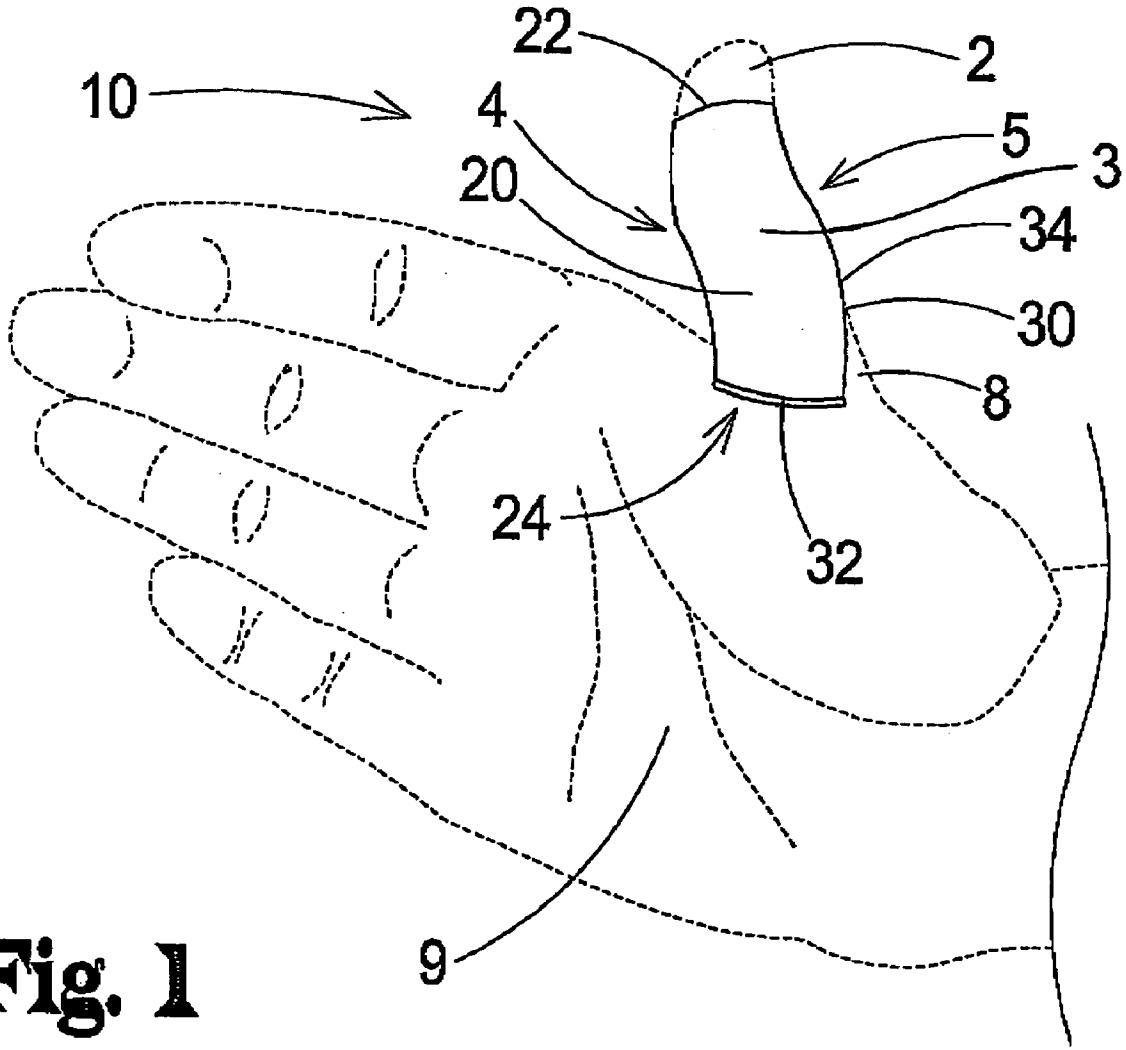
FIG. 1 is a side view of a new thumb protection device according to the present invention.
Figure 2:
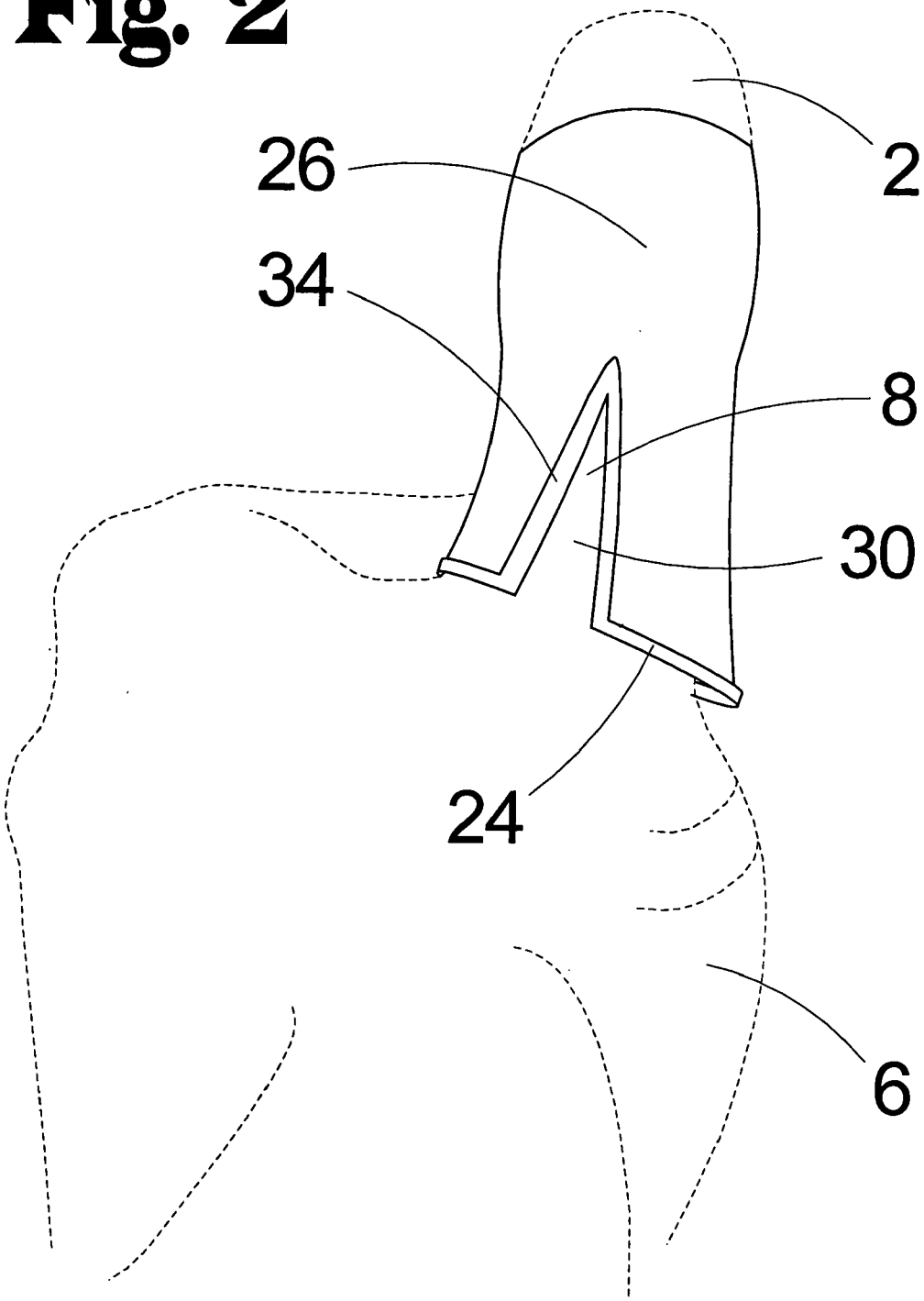
FIG. 2 is a top view of the present invention.
Figure 3:
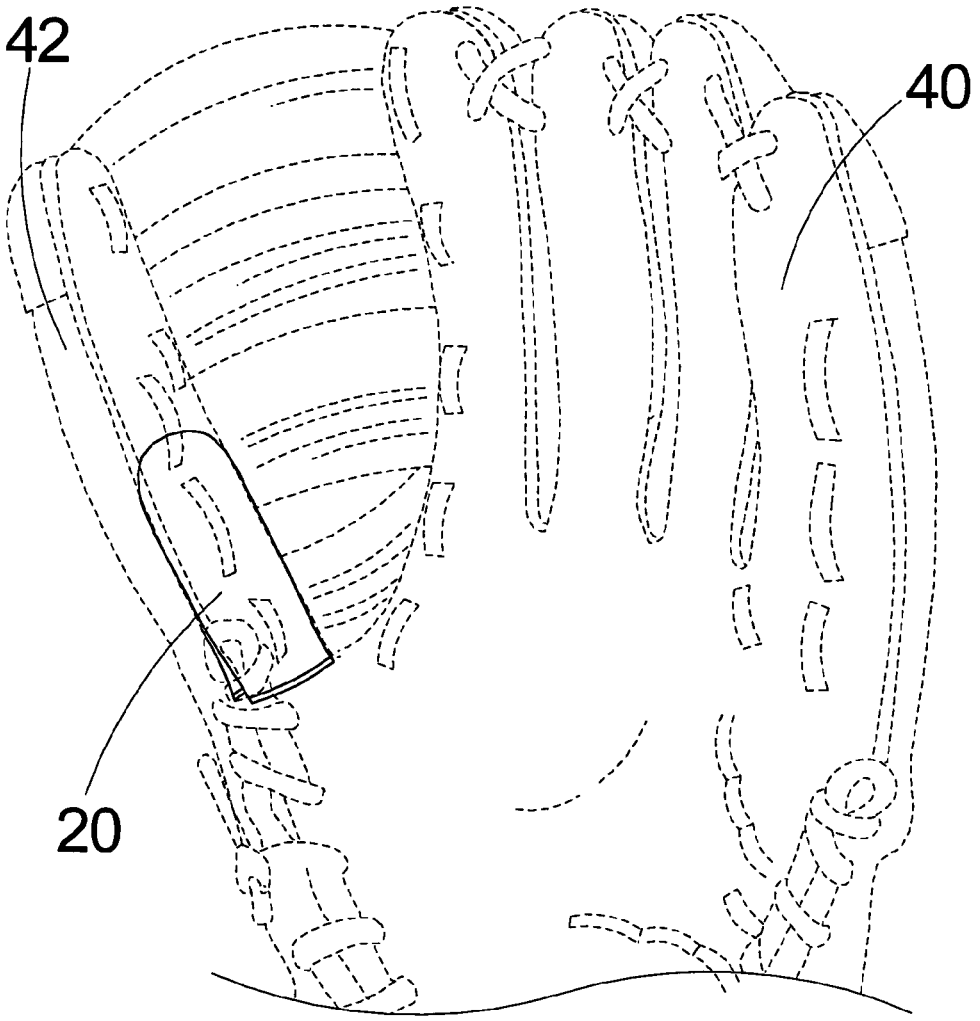
FIG. 3 is a front view of the present invention positioned for use within a sport glove.

With reference now to the drawings, and in particular to FIGS. 1 through 3 thereof, a new thumb protection device embodying the principles and concepts of the present invention and generally designated by the reference numeral 10 will be described.

As best illustrated in FIGS. 1 through 3, the thumb protection device 10 generally comprises a tubular main member 20 that has a pair of open ends 22, 24. Thus, the tubular main member 20 is designed for sliding over a thumb 2 of a user to cover a medial portion 4 of the thumb 2. The tubular main member 20 is constructed of a padding material 26 for cushioning impact forces applied to the medial portion 4 of the thumb 2 while playing a sport.

The tubular main member 20 includes a slit 30 extending from a proximal end 32 of the tubular main member 20 such that the proximal end 32 is expandable in diameter for accommodating thickening of the thumb 2 approaching a root 6 of the thumb 2. The slit 30 is alignable with a top side 8 of a hand 9 of the user for facilitating free flexing of a middle joint 3 of the thumb 2.

Reinforced edging 34 is coupled to the tubular main member 20 around the ends 22,24 and the slit 30.

The tubular main member 20 has a length of between 2 and 4 inches sufficient for covering a distal joint 5 of the thumb 2.

The tubular main member 20 is constructed of a resilient material such as rubber or plastic.

In one implementation of the invention, the tubular main member 20 is highly suitable for use in combination with a sport glove 40 having a thumb portion 42 designed for fitting over the thumb 2 of the user. The tubular main member 20 has an outer diameter cross-sectional area less than an interior cross-sectional area of the thumb portion 42. Thus, the tubular main member 20 is insertable into the thumb portion 42 for providing padding to the thumb 2 while the thumb 2 is inserted into the sport glove 40. In one embodiment of the invention, the sport glove 40 comprises a baseball glove in which the thumb portion 42 is positioned adjacent to a gap in finger portions of the glove to form a pocket or basket for receiving a baseball or softball in the basket between the thumb portion 42 and the rest of the finger portions.

Due to the singular proximity of the thumb portion 42 to the pocket area of the sport glove, the thumb of the user's hand is highly exposed and vulnerable to the impact of a baseball, softball, or other sport ball on the pocket of the sport glove, and the thumb protection device 10 of the invention greatly enhances the protection of the user's thumb provided by the sport glove 40.

In use, the thumb 2 is inserted through the tubular main member 20 such that the tubular main member 20 covers the medial portion 4 of the thumb 2. The slit 30 is aligned with the top side of the hand of the user for facilitating free flexing of the middle joint of the thumb 2. The thumb 2 and tubular main member 20 are inserted into the thumb portion 42 of the sport glove 40 when the user inserts the hand into the sport glove 40. The sport glove is then used as it would regularly be used for the particular sport being played.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A thumb protection device comprising:

a tubular main member having a pair of open ends whereby said tubular main member is adapted for sliding over a thumb of a user to cover a medial portion of the thumb;

wherein said tubular main member is constructed of a padding material for cushioning impact forces applied to the medial portion of the thumb while playing a sport; and said tubular main member includes a slit extending from a proximal end of said tubular main member such that said proximal end is expandable in diameter for accommodating thickening of the thumb approaching a root of the thumb, said slit being alignable with a top side of a hand of the user for facilitating free flexing of a middle joint of the thumb.

2. The thumb protection device of claim 1, further comprising reinforced edging coupled to said tubular main member.

3. The thumb protection device of claim 1 wherein said tubular main member has a length of between 2 and 4 inches.

4. The thumb protection device of claim 1 wherein said tubular main member has a length sufficient for covering a distal joint of the thumb.

5. The thumb protection device of claim 1 wherein said tubular main member is constructed of a resilient material selected from a group of resilient materials consisting of rubber and plastic.

6. A thumb protection system for protecting a thumb of a user from impact forces during playing of a sport, the system comprising:

a sport glove having a thumb portion adapted for fitting over a user's thumb;

a tubular main member having a pair of open ends whereby said tubular main member is adapted for sliding over the thumb of the user to cover a medial portion of the thumb;

wherein said tubular main member is constructed of a padding material for cushioning impact forces applied to the medial portion of the thumb while playing a sport;

said tubular main member having an outer diameter cross-sectional area less than an interior cross-sectional area of said thumb portion whereby said tubular main member is insertable into said thumb portion for providing padding to the thumb while the thumb is inserted into said sport glove; and said tubular main member having a slit extending from a proximal end of said tubular main member such that said proximal end is expandable in diameter for accommodating thickening of the thumb approaching a root of the thumb, said slit being alignable with a top side of a hand of the user for facilitating free flexing of a middle joint of the thumb.

7. A method of protecting a thumb of a user from impact while playing a sport, the steps of the method comprising:

providing a sport glove having a thumb portion adapted for receiving the thumb of the user;

providing a tubular main member for covering a medial portion of the thumb, said tubular main member being constructed of a padding material;

providing said tubular main member with a slit extending from a proximal end of said tubular main member such that said proximal end is expandable in diameter for accommodating thickening of the thumb approaching a root of the thumb, the steps of the method further comprising:

inserting the thumb through the tubular main member such that said tubular main member covers a medial portion of the thumb;

aligning said slit with a top side of a hand of the user for facilitating free flexing of a middle joint of the thumb; and inserting the thumb and tubular main member into the thumb portion of the sport glove when the user inserts a hand into the sport glove.

* * * * *